United States Patent [19]

Roumagnac

[11] Patent Number: 4,835,809

[45] Date of Patent: Jun. 6, 1989

[54] APPARATUS FOR AUTOMATIC CLEANING PARTICULARLY OF THE BOTTOM OF A SWIMMING POOL

[76] Inventor: Max Roumagnac, 7, rue Berlioz, F-33127 Martignas, France

[21] Appl. No.: 46,883

[22] PCT Filed: Aug. 5, 1986

[86] PCT No.: PCT/FR86/00279

§ 371 Date: Apr. 6, 1987

§ 102(e) Date: Apr. 6, 1987

[87] PCT Pub. No.: WO87/00883

PCT Pub. Date: Feb. 12, 1987

[30] Foreign Application Priority Data

Aug. 6, 1985 [FR] France ..... 85 12183

[51] Int. Cl.[4] ..... E04H 3/20

[52] U.S. Cl. ..... 15/1.7

[58] Field of Search ..... 4/490; 15/1.7; 134/167 R, 168 R

[56] References Cited

U.S. PATENT DOCUMENTS

| | | | |
|---|---|---|---|
| 2,988,762 | 6/1961 | Babcock | 15/1.7 |
| 3,008,159 | 11/1961 | Del Vecchio | 15/1.7 |
| 3,108,298 | 10/1963 | Gelinas | 134/167 R |
| 3,229,315 | 1/1966 | Watson | 15/1.7 |
| 3,979,788 | 9/1976 | Strausak | 15/1.7 |
| 4,023,581 | 5/1977 | Pansini et al. | 15/1.7 X |
| 4,100,641 | 7/1978 | Parsini | 15/1.7 |
| 4,141,101 | 2/1979 | Gibellina | 15/1.7 |
| 4,558,479 | 12/1985 | Greskovics | 15/1.7 |

FOREIGN PATENT DOCUMENTS

| | | | |
|---|---|---|---|
| 0003376 | 1/1979 | Japan | 15/1.7 |

*Primary Examiner*—Edward L. Roberts

*Attorney, Agent, or Firm*—Sandler & Greenblum

[57] ABSTRACT

An apparatus for filtering debris from a body of liquid, particularly for automatic cleaning of the bottom of a swimming pool. The apparatus includes a housing having a liquid inlet, a liquid outlet, and a filter located between the inlet and outlet. The apparatus is configured such that liquid is expelled from the housing through the outlet in a direction along a line which does not intersect the axis of symmetry of the housing, which tends to provide a force for rotating the housing about its axis of symmetry. A device is further provided for counteracting the rotational force to propel the apparatus substantially rectilinearly. When an obstacle is encountered by the apparatus, such as a wall of the swimming pool, the device for counteracting the rotational force is no longer effective to maintain rectilinear movement. Consequently, the apparatus rotates and then moves rectilinearly away from the obstacle or wall. Repeated movement in this manner is effective to remove debris from the entire bottom surface of the swimming pool or like surface. The apparatus can also be made to float and to thereby clean the upper surface of a body of liquid, particularly the upper surface of a swimming pool.

37 Claims, 2 Drawing Sheets

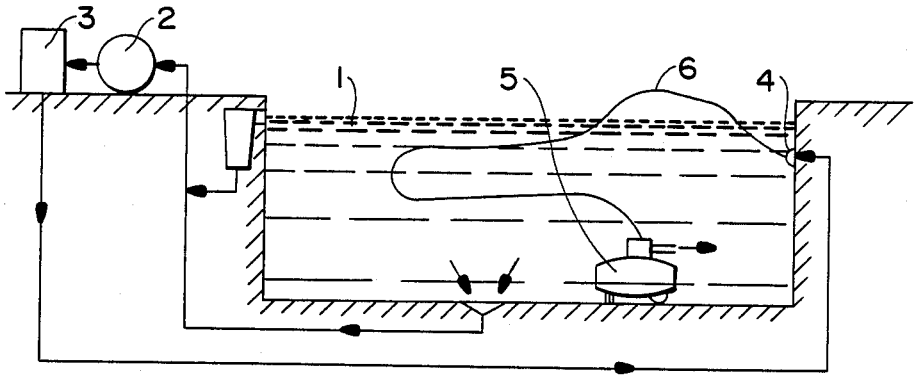
Fig. 1
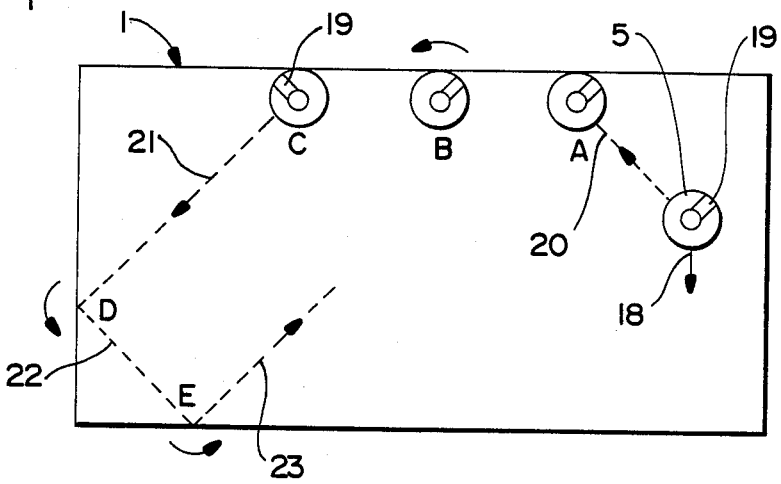
Fig. 2
Fig. 3
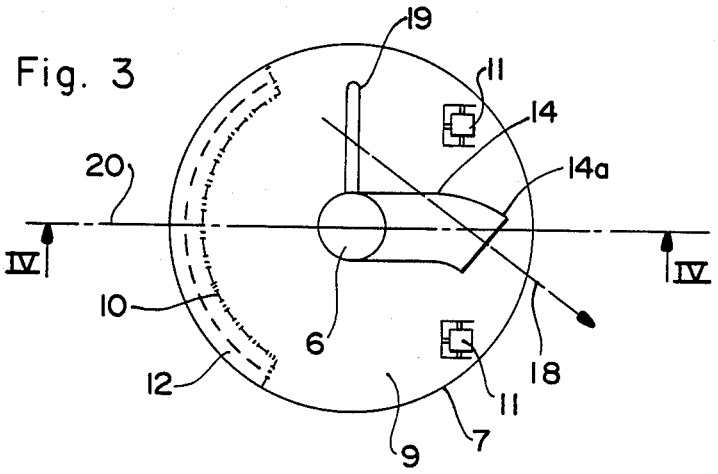

APPARATUS FOR AUTOMATIC CLEANING PARTICULARLY OF THE BOTTOM OF A SWIMMING POOL

BACKGROUND OF THE INVENTION

1. Field of the Invention

The present invention relates to an apparatus having automatic displacement capable of cleaning by aspiration in particular the bottom of a swimming pool or the like.

The cleaning of a swimming pool consists of removing the deposits which occur essentially on the bottom.

2. Background and Discussion of Relevant Information

This operation is performed most often, manually by means of a sweep connected to the general aspiration of the swimming pool.

This operation which must be performed once per week quickly becomes a chore which explains the value of automatic cleaning apparatus and their development despite an expensive price.

The available automatic apparatus on the market are classified in two major categories: agitators and aspirators.

The agitators are sorts of octopuses which are animated by a recycling of pressurized water.

Their role is to resuspend in the water the deposits which have occurred. The materials in suspension are then eliminated by the general filtration system of the swimming pool.

The aspirators are apparatus with automatic displacement on the bottom and if desired the walls of the pool, which are, either connected to the general aspiration by a floating pipe or a superpressurizer, or electrically controlled by an on board propulsive set programmed if desired.

The majority of displacement systems of these apparatus rely upon a sophisticated mechanism (turbines, gears, submerged pump, motor-reducer, end of path contacts) of an elevated manufacture and maintenance cost.

SUMMARY OF THE INVENTION

The present invention attempts to overcome these disadvantages and its aim is to provide an automatic operation apparatus, of simple design and utilizing the hydraulic energy of the recycling of the water of the swimming pool to assure the aspiration of the deposits and the propulsion of the apparatus.

To this end, the invention has as object an apparatus for the automatic cleaning particularly of the bottom of a swimming pool or the like, characterized in that it comprises an aspiration container in the general form of a flattened cylinder of vertical axis provided with a removable bottom defining therewith an aspiration orifice or mouth situated in a plane substantially parallel to the surface to be cleaned and at a small distance therefrom, and an outlet orifice of aspirated water, a filter positioned in the container between the said aspiration orifice and the said water outlet orifice, a means integral with the container adapted to aspirate the water of the container and to send it into a pipe carried by the container and oriented substantially parallel to the plane of the surface to be cleaned and a deflector wing attached to the container, the axis of the propulsive jet of the pipe being laterally offset with respect to the vertical axis of the container and cutting the plane of the deflector wing.

Such an apparatus is of the type to displace itself along the bottom of a pool by reaction along a straight line defined by the resultant of the propulsive force of the jet of the pipe and the braking force of the deflector wing, then, upon contact with a lateral wall of the swimming pool, to pivot to start again along another direction and to repeat the same pivoting against another wall, the apparatus displacing itself thus in the manner of a billiard ball return by the edges and finishing by passing over the entire surface of the bottom and thus completely cleaning it.

The water and the impurities and various debris covering the bottom are thus aspirated into the container, th impurities and debris are filtered and the water aspirated is ejected by the propulsive pipe.

The apparatus rests on the bottom by means of swivelling wheels and/or a brush positioned in a cordon adjacent to the said water aspiration orifice.

The propulsion means of the container can be an apparatus known as a hydro-injector and comprising a water injection inlet orifice connected by a flexbile pipe to a recycle mouth or the like of the swimming pool, a water aspiration orifice connected to the water outlet orifice of the container and a recycle pipe constituting the said propulsive pipe. This apparatus has the merit of utilizing traditional equipment of the swimming pool and of consuming practically no energy by virtue of the fact that the recycling system of the water of the swimming pool is practically always in action.

The propulsion means can likewise be constituted by an electric pump incorporated into the container and driving a turbine positioned in a conduit connecting the water outlet orifice of the container to the said propulsive pipe. The electricity is furnished, either by a floating electric cable connected to a grounded electric source, or from an on board battery.

This second propulsion means lends itself most particularly to providing an apparatus likewise capable of displacing itself on the surface of the water, the "head" down, and cleaning the surface by aspiration of the surface film of water. To this end, one or more removable floats are attached to the bottom and the container of the apparatus.

BRIEF DESCRIPTION OF THE DRAWINGS

Other characteristics and advantages will become clear from the description which follows of the embodiments of the apparatus of the invention, description given by way of example only and with reference to the annexed drawings in which:

FIG. 1 illustrates a vertical cross-section of a swimming pool with its equipment and an apparatus according to the invention in action on the bottom;

FIG. 2 illustrates the displacement of the apparatus on the bottom of the swimming pool;

FIG. 3 is a top view of a first embodiment of an apparatus according to the invention;

DETAILED DESCRIPTION OF THE INVENTION

Figure 4:
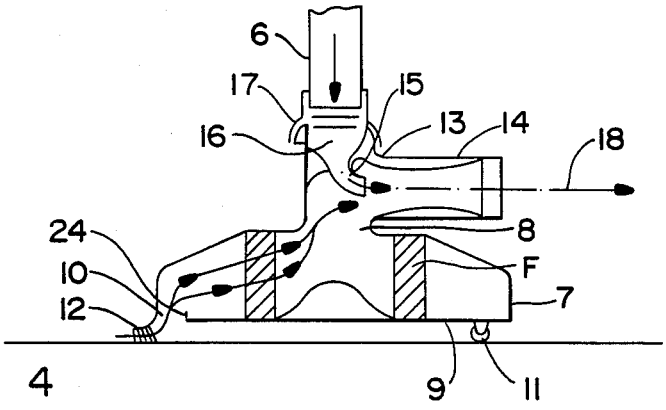
FIG. 4 is a vertical cross-section along line IV—IV of the apparatus of FIG. 3.

FIG. 1 shows a swimming pool 1 with its water aspiration pump 2, its filter 3 and a filtered water recycle mouth 4 in the swimming pool. At the bottom of the swimming pool a cleaning apparatus 5 displaces itself propelled by reaction force and connected by a flexible channel 6 to the recycle mouth 4.

FIGS. 3 and 4 schematically illustrate one embodiment of apparatus 5 schematically shown in FIG. 1.

The apparatus shown in FIGS. 3 and 4 is constituted by a container or housing having a substantially cylindrical outer wall with a 7 vertical axis open at its lower portion and having at its upper portion a circular orifice 8 coaxial with container 7, called a water outlet orifice.

The lower orifice is almost entirely blocked by a removable bottom 9 defining only with the lower edge of the container an orifice or outlet 10 called an aspiration orifice in the form of a narrow arched window, extending over approximately 120° of the circumference of the container 7.

On the opposite side of aspiration mouth 10 bottom 9 is provided with swivelling wheels 11. Adjacent the mouth the lower edge of container 7 is provided with an arched brush 12 having substantially the same shape and length as the lower edge of the container. The arched brush 12 and wheels 11 maintain the apparatus at a sufficient distance from the bottom of the swimming pool to allow for its displacement and appropriate aspiration of the various impurities and debris littering the bottom, after a preliminary brushing of the surface to be cleaned.

Within container 7 is positioned an annular filter F of the washable cartridge type for example, interposed between aspiration mouth 10 and water outlet orifice 8.

This orifice makes container 7 communicate with a reaction hydraulic propulsion apparatus 13 commonly called a hydro-injector.

Such an apparatus is well known and need not be described in detail. It comprises a propulsive tube 14 whose inlet is connected to the water outlet orifice 8 and an injector 15 opening onto the axis of pipe 14 and connected to an orifice 16 called an injection orifice coaxial with orifice 8 and connected by a turning connection 17 with flexible channel 6.

The body of the hydro-injector 13 has the general shape of a T, the pipe 14 being positioned horizontally. Furthermore, the outlet 14a of the pipe (FIG. 3) is directed on the side such that the axis 18 of thrust of the ejected water does not cut the vertical axis of the apparatus but is offset in a fashion so as to cut a deflector wing vertical plane 19 fixedly mounted on the container-hydro-injector assembly.

The angular position (FIG. 3) of pipe 14 and wing 19 with respect to the opening of aspiration mouth 10 is determined in a fashion such that in the water the conjugation of the propulsive force 18 with the reaction to the advancement caused by wing 19 causes a resultant force displacing the apparatus in a direction 20 in the axis of the aspiration mouth 10.

The trajectory of the apparatus in movement on the bottom of the swimming pool is shown in FIG. 2. It is more or less similar to that of a billiard ball which successively hits the sides of the billiard table and keeps moving such that it practically never passes over the same spot and thus arrives at the end of a certain number of successive changes of direction, to "cover" the entire surface on which it is displaced.

In the absence of an obstacle the apparatus 5 displaces in a rectilinear fashion. Arriving at abutment (A) against the wall of the swimming pool, the resistance to the advancement caused by the wing 19 disappears and the rotational movement which has a tendency to apply the offset propulsive force 18 on the apparatus 5 is no longer compensated such that apparatus 5 will pivot substantially on itself (B) around its vertical axis unitl the reaction of the wall (C) disappears and the wing 19 reassumes its full compensation effect. At this moment apparatus 5 is oriented in direction 21 and displaces itself practically in a straight line. In FIG. 2 out of concern for clarity three offset positions A, B, C of the apparatus are shown during the encounter with the wall. In reality the three positions are approximately superimposed Upon encountering D with another wall of the swimming pool the apparatus will again veer away from the edge and take off again along direction direction 22, to again veer at E and take off along direction 23; and thus continuing in a manner so as to "sweep" the entire bottom surface of the swimming pool at the end of a certain amount of time.

In the course of its displacements the brush 12 brushes the bottom thus raising the deposits. These are then aspirated by the reduced pressure created within container 7 by hydro-injector 13 and retained by the filter F. The aspirated water purified of its various debris is then directed towards pipe 14 and participates in the propulsive effort of the motor.

The connection of channel 6 to the recycle system 4 of the pool allows for a normal operation of the filtration installation of the water of the swimming pool which eliminates the impurities which would not have been arrested by filter F of apparatus 5. The latter necessitates therefore neither exterior installation nor additional energy.

Figure 5:
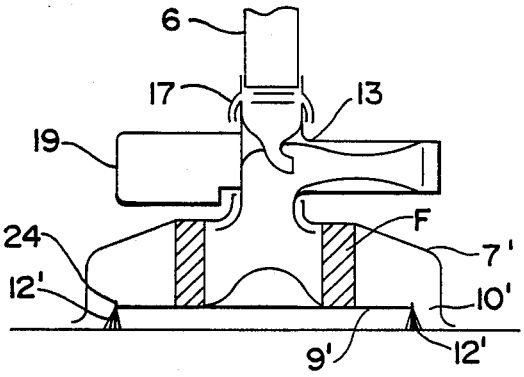
FIG. 5 is an axial vertical cross-section of an alternative embodiment of the apparatus of FIG. 4.

FIG. 5 illustrates an alternative embodimemnt in which the deflector wing assembly 19-hydro-injector 13 is mounted rotatable on container 7' in the manner of a weather vane.

The aspiration mouth 10' is, as a result, totally circular and the raised removable bottom 9' is provided with a brush 12' in the form of a circular cordon attached to the periphery of the bottom. The latter comprises, as the bottom 9 of the embodiment of FIG. 4, an internal edge 24 over the entire length of mouth 10', so as to hold fast the debris and impurities in the apparatus during the outward exit of the water from the apparatus, to empty it in particular and change the filter. The apparatus rests on the bottom of the swiming pool only by means of the brush cordon 12'.

It should be noted that the apparatus does not utilize adherence on the bottom of the swiming pool to displace itself and, as a result, its displacement on an inclined bottom does not pose a problem because there is no risk of sliding.

Figure 6:
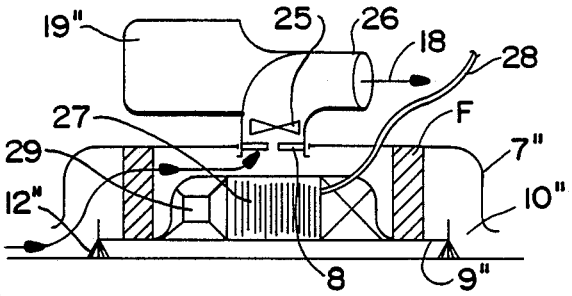
FIG. 6 is a vertical cross-section of another embodiment of an apparatus according to the invention.
Figure 7:
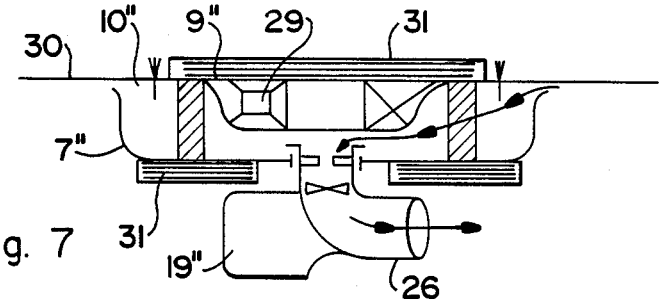
FIG. 7 illustrates the apparatus of FIG. 6, the "head" down for the cleaning of the surface of the water of the swimming pool.

FIGS. 6 and 7 illustrate another embodiment in which the propulsive reaction means is constituted by a turbine 25 positioned in a bent conduit 26 serving as a pipe and mounted rotatable on the water outlet orifice 8 of container 7" of the apparatus.

The turbine 25, of axis coaxial to the axis of container 7" is driven by an electric motor 27 attached on the bottom 9" within annular filter F. The aspiration mouth 10" is circular and provided with a brush cordon 12' as in the apparatus of FIG. 5.

The rotating pipe 26 has its end likewise oriented in an offset manner with respect to the vertical axis of the apparatus and is likewise provided with a deflector wing 19". The apparatus displaces itself exactly as those of the preceding figures.

The electric feed of motor 27 is assured, either by a floating electric cable 28 connected to a grounded electric source (sector or another), or from a group of batteries loaded on the apparatus as symbolically shown at 29. In this latter version the apparatus can be utilized to clean the surface of the water 30 (FIG. 7) of the swimming pool by placing the "head" down and making it float by virtue of one or more removable floats 31 attached to the bottom 9" and on the container 7" in a manner such that mouth 10" aspirates the film of surface water of the swimming pool.

In inverted position the apparatus displaces itself as easily by reaction and will pivot and start again in another direction by touching the edge of the swimming pool.

Finally, the invention is obviously not limited to the embodiments shown and described above but on the contrary covers all variations, particularly with respect to the shapes and arrangements of the propulsive pipe and the deflector wing as much with respect to one another as with respect to the container of the apparatus.

I claim:

1. Apparatus for the automatic cleaning of a bottom surface of a pool comprising a generally cylindrical aspiration container having a substantially vertical axis during operation provided with a removable bottom defining therewith an aspiration orifice situated in a plane substantially parallel to and spaced a small distance from said bottom surface to be cleaned, and an outlet orifice, a filter positioned in said container between said aspiration orifice and said outlet orifice, a means integral with said container for aspirating the water from said container, said apparatus further comprising propulsive means comprising a pipe connected to said means for aspirating said water to thereby send said water into said pipe along a predetermined axis, said pipe carried by said container and oriented substantially parallel to said surface to be cleaned, said apparatus further comprising a deflector wing positioned in a predetermined plane and attached to said container, said axis of said pipe being laterally offset to thereby not intersect said vertical axis of said container and intersecting said plane of said deflector wing.

2. Apparatus according to claim 1, wherein said propulsive means are constituted by a hydro-injector comprising an injector connected to a flexible pipe at a first end by means of a rotating connection, said rotating connection adapted to be connected at a second end to a recycle mouth of said pool.

3. Apparatus according to claim 2, wherein said hydro-injector is fixedly mounted on said container, said aspiration orifice having an arched shape and positioned in the axis of displacement of said apparatus, in the front of said apparatus.

4. Apparatus according to claim 3, wherein said aspiration orifice is provided with a brush cordon, swivelling wheels being attached to said bottom opposite to said aspiration orifice.

5. Apparatus according to claim 2, wherein said hydro-injector is mounted rotatably to said deflector wing on said container, said aspiration orifice being circular and provided with a brush cordon which is also circular.

6. Apparatus according to claim 1, wherein said propulsive means is constituted by a turbine driven by an on board electric motor and positioned in said pipe, said pipe being mounted rotatably to said deflector wing on said container of said apparatus.

7. Apparatus according to claim 6, wherein said on board motor is electrically driven by batteries, likewise on board, floats adapted to be attached onto said bottom of said apparatus to allow said apparatus to move in an inverse position on the surface of the water.

8. Apparatus according to claim 1, wherein said outlet orifice is coaxial to said vertical axis of said apparatus and said filter is an annular filter positioned in said container coaxially to said outlet orifice.

9. An apparatus for cleaning a body of liquid comprising:

(a) a housing having a first end and a second end;
(b) a liquid inlet located in said housing proximate said first end for receiving liquid and debris from said body of liquid;
(c) a liquid outlet located in said housing proximate said second end for discharging said liquid from said housing;
(d) means associated with said liquid outlet in said housing for propelling liquid through said liquid outlet;
(e) means for directing said liquid discharged from said housing through said liquid outlet along a first axis and for thereby providing a propelling force for displacing said apparatus within said body of liquid in a displacement direction; and
(f) means for maintaining said displacement direction of said apparatus substantially along a second axis which is angled relative to said first axis.

10. An apparatus according to claim 9, wherein said housing comprises a third axis which extends through said first end and said second end and, further, wherein said first axis is offset from said third axis.

11. An apparatus according to claim 10, wherein said means for maintaining said displacement direction of said apparatus is a deflector wing mounted on said housing.

12. An apparatus according to claim 11, wherein said axis is substantially vertical and said deflector wing comprises a substantially vertically extending surface.

13. An apparatus according to claim 12, wherein said surface is substantially perpendicular to said second axis.

14. An apparatus according to claim 13, wherein said first axis intersects said surface at a predetermined angle.

15. An apparatus according to claim 14, wherein said predetermined angle is oblique.

16. An apparatus according to claim 10, wherein said housing comprises a front portion facing substantially in said direction of displacement and wherein said means for maintaining said displacement direction of said apparatus further comprises said liquid inlet being located in said front portion of said housing.

17. An apparatus according to claim 16, wherein said second axis lies substantially in a plane which contains said third axis and wherein said liquid inlet is substantially symmetrical to said plane.

18. An apparatus according to claim 9, further comprising means for changing said displacement direction of said apparatus in response to said apparatus encountering an obstacle during its displacement.

19. An apparatus according to claim 18, wherein said means for changing said displacement direction of said apparatus comprises means for pivotably mounted at least a portion of said means for directing said liquid and at least a portion of said means for maintaining said displacement direction of said apparatus substantially along said second axis to said housing.

20. An apparatus according to claim 19, wherein said means for directing said liquid comprises a conduit and wherein said means for maintaining said displacement direction of said apparatus comprises a deflector wing.

21. An apparatus according to claim 20, whereby said housing comprises a substantially vertical axis and whereby said conduit and said deflector wing are mounted to pivot around said substantially vertical axis relative to said housing.

22. An apparatus according to claim 9, wherein said apparatus further comprises swivelling wheels connected proximate one of said first end and said second end.

23. An apparatus according to claim 22, wherein said means for directing said liquid discharged from said housing comprises a conduit and wherein said means for maintaining said displacement direction of said apparatus comprises a deflector wing, whereby aid conduit and said deflector wing are fixed against movement to said housing.

24. An apparatus according to claim 9, wherein said means for propelling liquid through said liquid outlet comprises a hydraulic propulsion apparatus connected for operative association with said liquid outlet and said means for directing said liquid discharged from said housing to thereby entrain liquid through said liquid outlet to said means for directing said liquid discharged from said housing.

25. An apparatus according to claim 24, wherein said housing comprises third axis which extends through said first and said second end and wherein said hydraulic propulsion apparatus comprises an inlet orifice substantially coaxial with said third axis for supplying entraining fluid to said hydraulic propulsion apparatus for entraining liquid through said liquid outlet.

26. An apparatus according to claim 25, further comprising a flexible conduit connected to said inlet orifice of said hydraulic propulsion apparatus adapted to be connected to a filtered water recycle mouth of a swimming pool.

27. An apparatus according to claim 24, further comprising means to power said hydraulic propulsion apparatus.

28. An apparatus according to claim 27, wherein said means to power said hydraulic propulsion apparatus comprises an electric motor.

29. An apparatus according to claim 28, wherein said means to power said hydraulic propulsion apparatus further comprises batteries.

30. An apparatus according to claim 9, wherein said means for propelling liquid through said liquid outlet comprises a power-driven impeller mounted substantially coaxially with said liquid outlet.

31. An apparatus according to claim 30, wherein said means for directing said liquid discharged from said housing through said liquid outlet comprises a conduit having a first end connected to said liquid outlet and said power-driven impeller is mounted for rotation within said conduit for discharging liquid from said housing from a second end.

32. An apparatus according to claim 31, wherein said first end of said conduit is rotatably mounted relative to said housing.

33. An apparatus according to claim 9, wherein said apparatus further comprises means for enabling said apparatus to

34. An apparatus according to claim 9, further comprising means connected proximate said first end of said housing to dislodge debris from a surface of said body of liquid.

35. An apparatus according to claim 34, wherein said means to dislodge debris comprises a brush.

36. An apparatus according to claim 9, further comprising filtering means located in said housing for filtering said debris from said liquid before said liquid is discharged via said liquid outlet.

37. An apparatus for filtering debris from a body of liquid comprising a housing, said housing comprising a liquid inlet and a liquid outlet and an axis of symmetry, means for filtering located between said inlet and said outlet, means for expelling liquid from said housing through said liquid outlet in a direction along a line not intersecting said axis of symmetry, for providing a propelling force to said apparatus, and means fixed relative to said outlet for directing said apparatus substantially rectilinearly within said body of liquid.

* * * * *

UNITED STATES PATENT AND TRADEMARK OFFICE

CERTIFICATE OF CORRECTION

PATENT NO. : 4,835,809

DATED : June 6, 1989

INVENTOR(S) : Max ROUMAGNAC

It is certified that error appears in the above-identified patent and that said Letters Patent is hereby corrected as shown below:

At column 2, line 15, change "th" to ---the---.

At column 4, line 18, insert ---.--- after "superimposed".

At column 7, line 41, insert ---a--- after "comprises".

At column 8, line 28, after "to" insert ---float within said body of liquid.---.

Signed and Sealed this

Twenty-ninth Day of September, 1992

*Attest:*

DOUGLAS B. COMER

*Attesting Officer*

*Acting Commissioner of Patents and Trademarks*